United States Patent [19]

Zink et al.

[11] 4,201,191

[45] May 6, 1980

[54] LIQUID FUELS VAPORIZATION

[75] Inventors: John S. Zink; Robert D. Reed, both of Tulsa, Okla.

[73] Assignee: John Zink Company, Tulsa, Okla.

[21] Appl. No.: 873,728

[22] Filed: Jan. 30, 1978

[51] Int. Cl.[2] ..... F24H 1/20; F22B 13/00

[52] U.S. Cl. ..... 126/360 A; 60/39.57; 62/52; 122/33; 165/104 R; 165/111

[58] Field of Search ..... 126/360 A; 122/33; 60/39.65, 39.57; 62/52; 165/104 R, 111

[56] References Cited

U.S. PATENT DOCUMENTS

| | | | |
|---|---|---|---|
| 3,138,150 | 6/1964 | Hyer et al. | 126/360 A |
| 3,246,634 | 4/1966 | Stevens | 122/33 |
| 3,368,548 | 2/1968 | Santoleri et al. | 126/360 |

FOREIGN PATENT DOCUMENTS

| | | | |
|---|---|---|---|
| 2061435 | 6/1972 | Fed. Rep. of Germany | 126/360 |

*Primary Examiner*—James C. Yeung
*Assistant Examiner*—Daniel J. O'Connor
*Attorney, Agent, or Firm*—Head & Johnson

[57] ABSTRACT

Apparatus for vaporization of liquids having a boiling point lower than that of water, comprising a vessel having at least three narrow planar plena, contiguous to each other, so that there is a single metal wall between each adjacent pair of plena. Gaseous fuel and air is supplied to the first plenum to provide a downflowing flame and hot products of combustion which, at the bottom of the first plenum, pass through the wall into the second plenum, which is filled with water. The hot gases and water rise rapidly in the second plenum and the water flows over the intervening wall into the third plenum, which is also filled with water, which moves downwardly and back under the wall separating the second and third plena, and again rises in the second plenum. A vertical array of horizontal pipes is arranged in the third plenum, through which the liquid to be vaporized is flowed. Means are provided at the base of the first plenum, to distribute the flow of hot gases substantially uniformly over the cross-section, to provide more rapid and uniform heat transfer from the hot gases to the liquid. The hot water flowing downwardly over the pipes in the third plenum, transfers heat to the liquid therein, which flows countercurrently, upwardly through the pipes in zig-zag fashion. The cooled products of combustion are vented from the top of the space above the second and third plena to a stack. An optimum embodiment comprises a symmetrical assembly with duplicate second and third plena on each side of the first plenum.

10 Claims, 7 Drawing Figures

LIQUID FUELS VAPORIZATION

CROSS-REFERENCE TO RELATED APPLICATION

Reference is made to an application Ser. No. 869,712 covering a thin planar combustion chamber with downwardly directed flame, which would be suitable for application in this invention.

BACKGROUND OF THE INVENTION

1. Field of the Invention

This invention lies in the field of submerged burning devices. More particularly, it concerns a submerged burner for heating water, which is utilized immediately for heat transfer to a vaporizable liquid.

Still more particularly, this invention can be used for, or is in the field of, apparatus for vaporizing liquid fuels and the like.

2. Description of the Prior Art

It is well known in industry that volatile fuels, which are stored or retained in liquid phase, must be vaporized prior to gaseous phase burning in burners, which are designed for gaseous fuels. Also, non fuels, such as nitrogen or oxygen, are stored or retained in liquid phase and require vaporization prior to the normal use.

The invention to be described is a vaporizer for such liquids, which may be liquified natural gas, liquified petroleum gases, other hydrocarbon liquids or liquid fuels, as well as oxygen, nitrogen or other non-fuel liquids. The type of liquids to be vaporized are those which have a boiling point which is lower than that of water, so that hot water can be used as the medium of heat transfer from flame products to the liquid to be vaporized.

The art on vaporization shows a number of devices of various forms. Some of the devices rely on thermally-induced convection for heat transfer from water through tubes to a liquid for vaporization. Others rely on turbulent movement of a mixture of hot gases and hot water over the tubular heat transfer surfaces. Such a one is illustrated in U.S. Pat. No. 3,138,150. Still others inject hot combustion gases directly to the liquid, which is vaporized.

In such devices, particularly those in which heat transfer is from water to tubes or pipes, which contain the liquid for vaporization, there are problems of considerable magnitude. The first is the need for maximal rate of heat transfer to the tubes to minimize structural size. The second is the very low temperature of some of the liquids and the danger of freezing water on the tubes to render them inoperative. For example, the temperature of liquified natural gas is less than −258° F., while that of liquid nitrogen is less than −320° F. and rapid movement of water over the tubes is demanded to avoid freezing of the water heat medium. Thus, thermally-induced convection movement of the water is just barely adequate at the expense of extra tubular heat transfer area, as compared to a system which causes much more brisk movement of the water heat medium.

If the heat transfer from the water to the tubes is due to convection, heat transfer by convection will vary as a power of the water flow velocity. In other words, if the water flow velocity can be doubled at constant temperature, say, from 1 foot per second to 2 feet per second, heat transfer to the tube will be increased by 41%, to both reduce the need for heat transfer surface, and better avoid freezing. The water content of the vaporizer is heated, either directly or indirectly, by causing flow of hot combustion gases, either directly into the water or by firing into a structure which is immersed in the water for structure heat transfer to the water. The former is much more efficient and requires the burning of less fuel per unit quantity of vaporized liquid for, improved energy conservation.

Means for causing high velocity water movement within the heat transfer area is a much sought function, and particularly, if the velocity can be accomplished without expenditure of additional energy. The phenomenon of "gas lift" pumping of water is admirably suited here. The combustion gases produced as fuel burns, provides the gas volume for "gas lift" pumping action, as well as the heat which is required for vaporization. This feature is present in this invention, as well in U.S. Pat. No. 3,138,150.

The prior art, and particularly that of U.S. Pat. No. 3,138,150, provides the heat exchange pipes which carry liquid for vaporization immersed in a mixture of gas and water. In this invention, the gas is delivered to the water in a second plenum and the heat of the hot water is retransferred to the tubes of liquid to be vaporized, in a third plenum. In this process, there is not contact of gas with the tubes, and only gas-free water is in contact with the heat exchange tubes. This is done for a number of reasons. First, research shows clearly that the gas temperature, where the gas is very hot, drops to very close to the water temperature within a distance of six inches of the point of gas-to-water injection. Therefore, the gas and water are essentially at the same temperature. Those versed in the art of heat transfer know that, at a selected temperature level, the heat transfer capability of a gas to a metal surface is a small fraction of the heat transfer capability of water to a metal surface. Therefore, the presence of gas in the water contacting a heat transfer surface actually interferes with, and reduces the rate of heat transfer.

It is true that in the case of more rapid movement of the gas, certain turbulence is created within the water. However, greatly increased turbulence is required to compensate for lack of heat transfer capability due to the presence of the gas within the heat transfer area.

SUMMARY OF THE INVENTION

A primary object of this invention is to provide an efficient type of heat transfer from hot gas to water and from water to liquid to produce an efficient vaporizer.

It is a further object of this invention to provide a vaporizer system utilizing water as an intermediate carrier of heat from hot gases to cold liquid for the most efficient heat transfer operation.

It is a further object of this invention to provide an improved heat transfer from hot gases to water by admitting hot gases through a plurality of ports distributed substantially uniformly across the cross-section of a column of water so that the transferred heat will provide water of substantially uniform high temperature throughout the cross-section at any level.

It is a still further object of this invention to provide heat transfer from water to the tubes carrying the liquid to be vaporized, in which gas-free water is used to contact the tubes, and to provide high flow rate of water across the tubes.

It is a still further object of this invention to provide "gas lift" pumping means to circulate the heated water in counter flow to the liquid in the heat transfer tubes, at high velocity, for most efficient heat transfer.

These and other objects are realized and the limitations of the prior art are overcome in this invention by providing at least three separate plena, which are narrow planar rectangular chambers, contiguous to each other, so that a single intervening wall separates the first plenum from the second plenum, and a second wall separates the second plenum from the third plenum.

Submerged combustion means are provided to generate flame and hot gases which transfer heat to water in the second and third plena, through the first wall, separating the first and second plena. The hot gases resulting from the combustion pass from the first plenum to the second plenum through means at the bottom of the first plenum, so that the hot gases flow into the water in the second plenum through a large plurality of ports distributed, more or less, uniformly over the horizontal cross-section of the second plenum.

The hot gases flow through the ports into the water and rise in the water, transferring heat directly to the water. As a result, the gases are rapidly cooled to the temperature of the heated water. The gas-pumping effect of the reduced average density of the water plus gas, compared to the gas-free water in the third plenum, provides a circulatory force carrying gas and water upwardly in the second plenum, where the gas is freed from the water at the top of the second plenum, the water flowing over the intervening wall between the second and third plena, so that the hot water flows downwardly in the third plenum, for rapid flow over the tubes carrying the liquid to be vaporized.

The cold liquid to be vaporized comes into the pipes at the bottom and rises in a zig-zag fashion through the horizontal tubes. The flow of cold liquid is countercurrent to the downward flow of the hot water. At the bottom of the third plenum the water is cooled, and flows under the intervening wall between the second and third plena, and rises past the ports through which hot gases are being injected into the water column, and the process is repeated.

For optimum efficiency a single, planar, narrow combustion chamber is utilized. The cross-section of this chamber is a long thin rectangle. In this form design of horizontal length may be made to accomodate greater or less heat transfer capacity.

Furthermore, a fourth and a fifth plenum can be provided which are mirror images of the second and third plena respectively, and are placed on the opposite side of the first plenum, to provide a symmetrical package in which the hot flames flow downwardly in the first plenum transferring heat from the flame through the intervening walls into the second and fourth plena, and the products of combustion, or hot gases, flow upwardly in the second and fourth plena, the water being heated by the gases and the gases providing a pumping effect to circulate water up in the second plenum over the top of the dividing wall and as gas-free water downwardly in the third and fifth plena, and across suitable piping in both of these zones.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
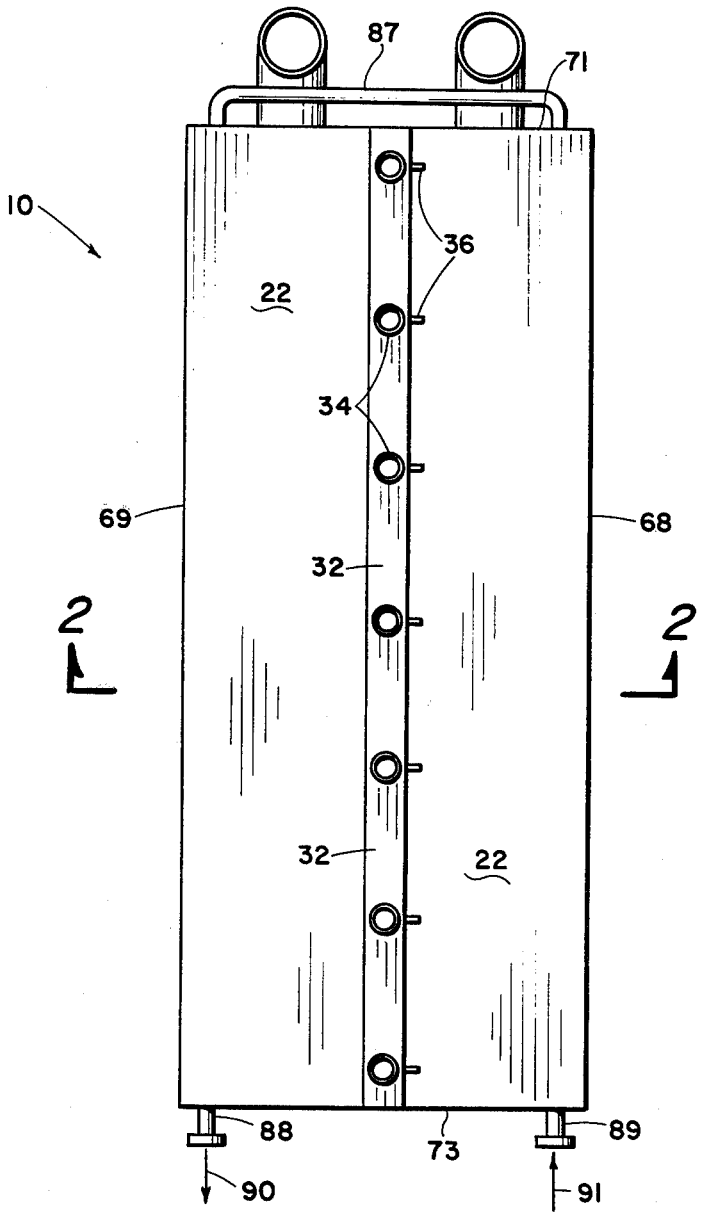
FIGS. 1, 2 and 3 illustrate, respectively, an overall plan view, a vertical cross-section, and a horizontal cross-section through one embodiment of this invention.
Figure 2:
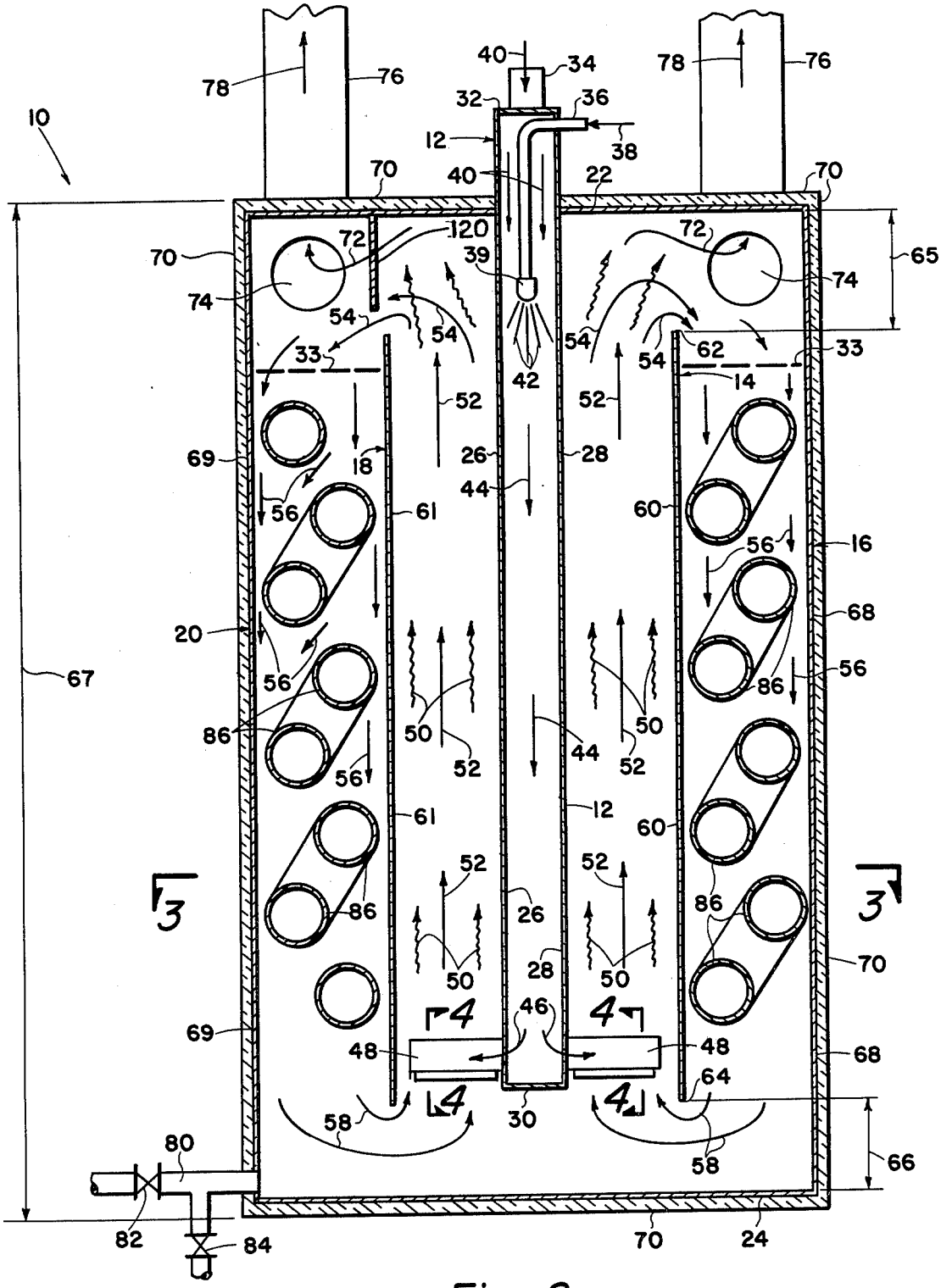
Figure 3:
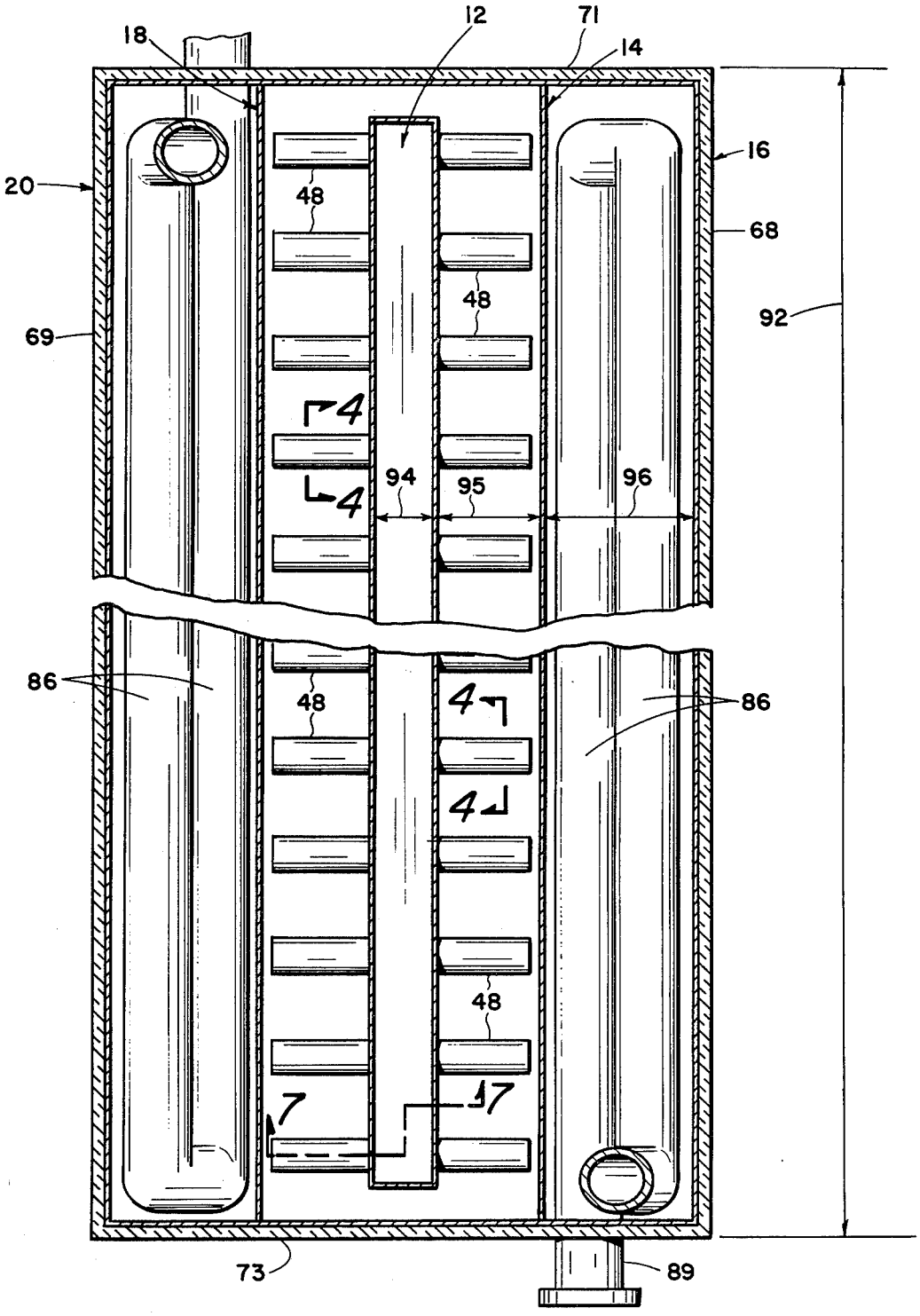

Referring now to the drawings and, in particular, to FIGS. 1, 2 and 3, there are shown three views of one embodiment of this invention, illustrated generally by the numeral 10.

The device is a rectangular chamber or vessel considerably longer than its width in plan. It is also of substantial height.

Illustrated in FIG. 2 is a vertical cross-section taken through the plane 2—2 of FIG. 1. There is a first plenum 12 which is quite narrow and has a length equal to that of one vessel and a vertical extent slightly less than the height of the vessel. The overall height of the vessel as indicated by 67 and the overall length by numeral 92, in FIG. 3.

There is a second plenum 14 which is slightly wider than the first plenum and of the full length 92 of the chamber. This second plenum 14 is confined between the wall 28, which serves to enclose the first plenum 12 and serves as a wall for the second plenum 14 and an outer wall 60 of the second plenum, which serves also as a wall for the third plenum 16, which is confined between the wall 60 and the outer wall of the vessel 68. Thus, a first single metal wall separates the first plenum from the second plenum and a second single wall 60 separates the second plenum from the third plenum. The second wall 60 is shorter than the overall height 67 of the vessel. Its top edge 62 is a distance down from the top 22 of the vessel by a dimension 65 and its bottom edge 64 is above the bottom 24 of the vessel by a dimension 66.

Similarly, on the opposite side of the first plenum 12 is a fourth and fifth plenum, separated by a wall 61 corresponding to the wall 60, which divides the second from the third plenum.

FIG. 1 shows the walls 68 and 69, of the third and fifth plena, which form the outer walls of the vessel 10. There are two end walls 71 and 73, which are also shown in FIG. 3. The first plenum or combustion chamber 12 extends upwardly above the top 22 of the vessel. The first plenum 12 is closed at the top by plate 32 through which a plurality of conduits 34 are passed and sealed, through which combustion air is provided under pressure, in accordance with arrow 40. Fuel gas is supplied by the pipe 36 in accordance with arrow 38. This pipe bends downwardly in the plenum, or combustion chamber, and terminates in a nozzle 39 which provides jets of gas 42 which are supplied with air in accordance with arrows 40. The gas burns and passes as a flame 44 down between the walls 26 and 28. The walls are made of steel, and immediately behind the steel there is water, which fills the second, third, fourth and fifth plena to a selected level, such as 33, for example. The plenum 12 is closed off at the bottom by a plate 30.

As shown more clearly in FIG. 3, there is a plurality of horizontal short pipes 48, which are sealed through the walls 26 and 28, near the bottom thereof, and extend equally, laterally of the combustion chamber, toward the walls 60 and 61 that bound the second and fourth plena.

Figure 4:
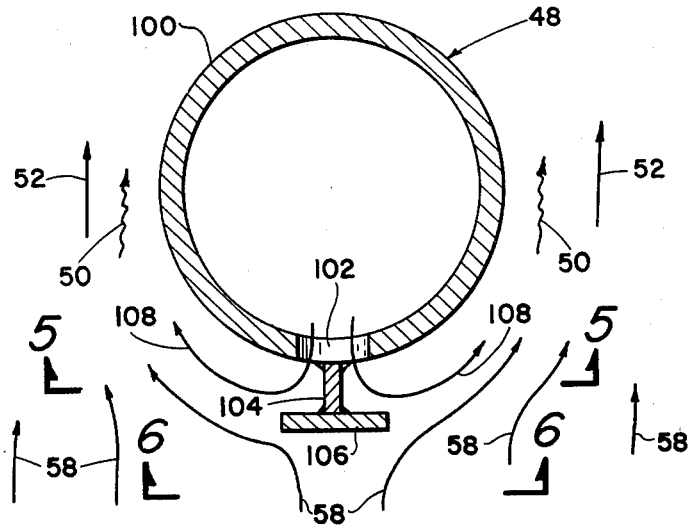
FIGS. 4, 5, 6 and 7 represent various views of the bottom of the combustion zone providing detail of the means for flow of hot combustion products into the water in the second plenum.
Figure 5:
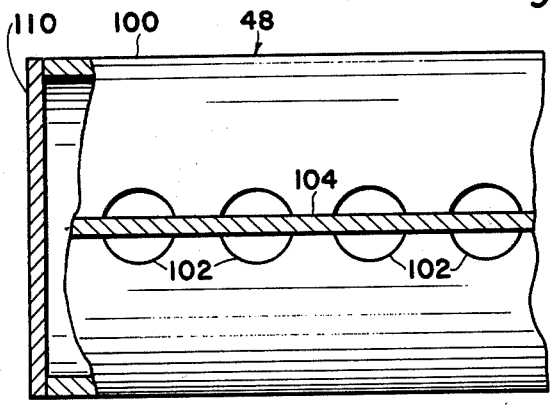
Figure 6:
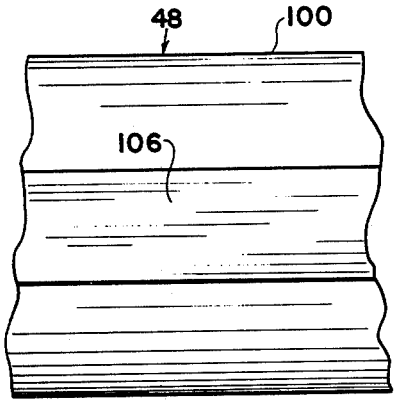

Turning to FIGS. 4, 5, 6 and 7, there are shown several cross-sectional views of these horizontal pipes indicated generally by the numeral 48. They comprise steel pipes 100 which have, as shown in FIG. 5, a plurality of spaced openings 102 drilled through the bottom of the pipes. There is a short narrow strip 104 which is welded along the bottom edge of each of the pipes 100, and across the openings 102, to divide the area of the openings into two proximately semi-circular areas. There is a horizontal strip baffle 106 welded below the vertical strips 104.

As shown in FIG. 4, the baffle serves to divert water moving upwardly toward the pipe 100 in accordance with arrows 38 and 58, and provides an opportunity for the gas in the pipes 100 to flow downwardly and outwardly in accordance with arrows 108, and to mix with the uprising water in accordance with the arrows 38 and 58. As the gas and water rise, they are indicated by a wiggly arrow 50 as gas and a linear arrow 52 as water and as shown in FIG. 2, these rise together to the surface of the water. The water flows over the top edge 62 of the walls 60 and 61, in accordance with arrows 54.

At this point, the gas escapes from the water into a space above the water, adjacent the top plate 22. The gas then flows in accordance with arrows 72 through suitable openings 74 into stacks 76, and flows to the atmosphere in accordance with arrows 78. While the openings 74 are shown in the end plates 71, they could equally well be positioned in the top plate 22, or along the walls near the top of side plates 68 and 69, for example. Also, baffles 120 may be provided to minimize the flow of water droplets with the gasous products.

The water indicated by arrows 54, flowing over the top of the walls 60 and 61, then flows downwardly in accordance with arrows 56 through the third and fifth plena and over the horizontal pipes 86, which are extended horizontally in a zig-zag pattern, one above the other, in the third and fifth plena.

FIG. 1 shows a horizontal pipe 87 joining the two rows of pipe 86 across one end of the vessel. Any type of liquid flow can be provided with suitable cross-connection. However, it would be desirable to bring the cold liquid into the pipe 89 at the lowest level in the third plenum and have the water traverse the successive horizontal length of pipe or tube to the topmost, and then connect again either internally or externally to the lowest pipe on the fifth plenum and have it rise through the top and exit as pipe 88 through which the heated liquid or vaporized liquid or gas 90 would flow out. Another desirable method would be to flow liquid in parallel into the bottom pipes, and out of the top pipes in parallel to obtain full counterflow of the water and liquid.

Figure 7:
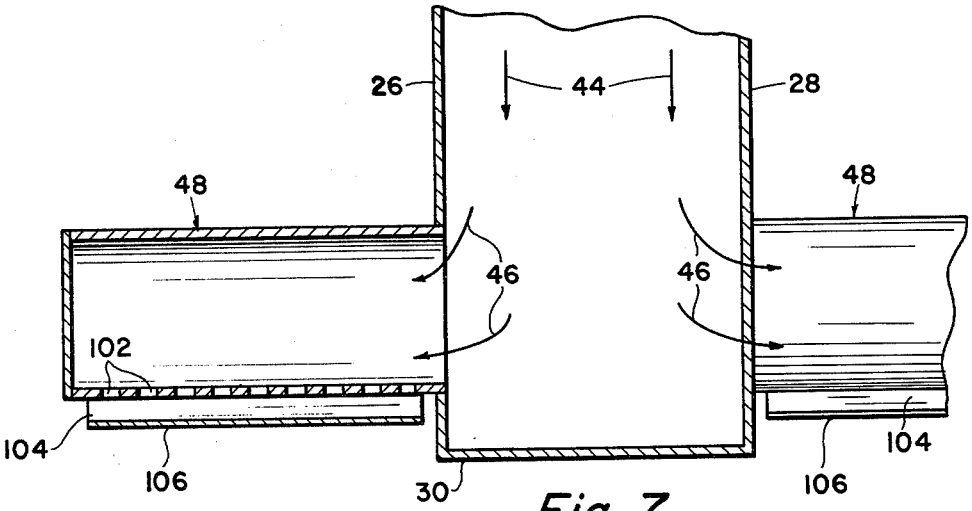

FIG. 7 is an enlarged view of the lower portion of FIG. 2 and shows the walls 26 and 28 of the first plenum with a bottom closure plate 30 and two of the pipe assemblies 48 extending through the bottom of the side walls outwardly into the second and fourth plena. Also shown are the vertical strips 104 and the horizontal baffles 106, which are positioned below the ports 102 which are drilled substantially uniformly spaced towards the outer walls of the second and fourth plena. By this arrangement of pipes and ports, there will be a relatively uniform delivery of hot gas over the horizontal cross-section of the water in the bottom of the second and fourth plena, and, thus, assuming that all the gas is at the same temperature, the heat transferred from the gas to the water by immediate contact of the small bubbles of the hot gas will cause the water to heat uniformly over the cross-section of the two plena, in which the water and gas rise together.

In this type of construction illustrated in FIGS. 2 and 3, etc., there is considerable heat transfer by the flame 44 in the combustion zone of the first plenum to the walls 26 and 28, and through the walls to the water on the opposite side. This is in addition to the heat transfer to the water by the hot gas through the form of bubbles issuing from the ports in the pipes 48, which carry the hot gases from the first plenum into the bottom of the second and fourth plena.

The rising hot gas flowing into the water causes the average density of the water plus gas in the second plenum, for example, to be considerably less than the density of the water in the third plenum. Since the second and third plena form, in essence, a U-tube and similarly, the fourth and fifth plena due to the lower density of water in the second and fourth plena, there will be a strong force causing upward flow of the water plus gas by what is known as "gas lift" flow and a correspondingly downwardly flow of gas-free water in the third and fifth plena.

As previously mentioned, the hot gases flowing into the water in the second and fourth plena as a series of bubbles, are quickly cooled by the water. After a relatively short flow together upwardly, the gas and water are at substantially the same temperature, and the water has been heated substantially to its highest temperature, except for the heat transfer through the walls 26 and 28. At the top of the second plenum, as the water flows over the edge 62 of the wall 60, for example, the gas is released and flows out through the opening 74 and through the stack 76. The gas-free hot water then continues to flow down into the third and fifth plena, in accordance with arrows 56 and to flow as gas-free water over and around the horizontal tubes 86, to transfer heat from the hot water to the tubes, and to the liquid therein. At the bottom of third and fifth plena the water flows around the bottom edge 64 of the walls 60 and 61, and as cooled water, in accordance with arrows 58 flows upwardly again in the second and fourth plena to repeat the cycle.

What has been described is an improved, more efficient type of heat transfer device for heating liquids that have a lower boiling point than that of water, to cause vaporization of the liquid. The design of the present invention provides a number of advantages over the prior art, such as the following, for example:

1. The rectangular design having a long wall surface provides for a larger heat flow from the flame through the wall to the water and therefore, a greater capacity for vaporization. Also, since the wall system is symmetrical about its long axis, the design of the vessel can provide increased length if there is need for greater heat transfer.

2. A more effective heat transfer is maintained between the hot gases and the water by the pipes 48 which provide substantially uniform distribution of hot gas over the cross-section of the water at the bottom of the second and fourth plena.

3. There is maximum efficient heat transfer from the heated water to the pipes in the third and fifth plena, particularly because of the absence of the gas. In other designs which show the pipes positioned in the second plenum, there is a mixture of gas and water which flows over the pipes and since the heat transfer rate of gas to the pipes is very much less than that of water to the pipes, a lessened efficiency of heat transfer to the pipe is obtained, if gas and water are mixed.

By separating the heat transfer from the flame and hot gases to the water from the transfer of the heat from the hot water to the pipes, a more efficient overall heat transfer to the pipes is obtained and, consequently, a lesser area of pipe is needed.

4. By providing counterflow of hot water over the pipes compared to the direction of flow of cold liquid in the pipes, a more effective heat transfer is obtained.

In FIG. 2 is shown a heat insulation layer over all outer surfaces, top, bottom and sides of the vessel 10. This is conventional and needs no further description.

In the design of the third and fifth plena, care must be given to the average cross-section of water flow over the pipes and between the walls. The space must run full of water to ensure maximum contact of hot water with the pipes.

Also, by restricting this cross-section for water flow, the velocity of flow of the water will increase, relative to second plenum, with consequent higher rate of heat transfer.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. Apparatus for vaporization of liquids having a boiling point lower than that of water, comprising;

(a) a first, narrow planar plenum having first and second walls oriented with their plane vertical, the first and second walls of said plenum being of metal and of substantial horizontal length;

(b) a plurality of nozzles spaced along the top of said first plenum, for injecting fuel gas downwardly into said plenum, between said first and second walls and means to inject combustion air downwardly into said first plenum, the bottom of said plenum closed;

(c) second, narrow planar plena, one contiguous with the first wall and another contiguous with the second wall of said first plenum;

(d) means to selectively flow said combustion products through openings adjacent the bottom of said first plenum into the bottom of said second plena;

(e) a third plenum contiguous with said one of said second plenum and a fourth plenum contiguous with said another of said second plenum;

(f) the outer wall of said third and fourth plena taller than the inner wall of said third and fourth plena, and including a top and bottom and end closures attached to said outer walls to confine all of said plena;

(g) said second, third and fourth plena filled to a selected level with water;

(h) a plurality of horizontal spaced pipes arranged in a zig-zag connection within said third and fourth plena for carrying liquid to be vaporized from an inlet to the spaced pipes in the third plenum at the bottom thereof, through a cross-over pipe connecting the top of the spaced pipe in the third plenum with the top of the spaced pipe in the fourth plenum, thence through an outlet from the spaced pipe in the fourth plenum at the bottom thereof; and (i) at least one stack means connected to the space above said second, third and fourth plena for the escape of cooled products of combustion to the atmosphere.

2. The apparatus as in claim 1 in which said means to flow said combustion products from the bottom of said first plenum to the bottom of said second plenum comprises openings in said first and second wall near the bottom of said first plenum.

3. The apparatus as in claim 2, in which said openings have horizontal short lengths of pipe closed at their outer ends welded thereto, and including a plurality of ports along the underside of said pipes.

4. The apparatus as in claim 3 including baffle plates attached to said pipes below said ports.

5. The apparatus as in claim 1 in which said at least one stack means comprises a plurality of separate stacks spaced along the top of the second wall of said third plenum.

6. The apparatus as in claim 1 including baffle plates mounted in front of the openings leading to said stack means.

7. The apparatus as in claim 1 in which the water in said second and third plena circulates upwardly in said second plenum and downwardly in said third plenum driven by the gas-lift effect of said products of combustion flowing into the bottom of said second plenum.

8. The apparatus as in claim 1 in which the cross-section for downward flow of water in said third plenum is selected for maximum velocity of flow downward in said third plenum.

9. Apparatus for vaporization of liquids having a boiling point lower than that of water, comprising;

(a) at least a first, narrow planar plenum, oriented with its plane vertical, the first and second walls of said plenum being of metal and of substantial horizontal length;

(b) a plurality of nozzles spaced along the top of said plenum, for injecting fuel gas downwardly into said plenum, between said first and second walls and means to inject combustion air downwardly into said plenum, the bottom of said plenum closed;

(c) at least a second, narrow planar plenum contiguous with said first plenum;

(d) means to selectively flow said combustion products from the bottom of said first plenum into the bottom of said second plenum through horizontal short lengths of pipe, closed at their outer ends and welded to said first and second walls near the bottom of said first plenum, each of said pipes having a plurality of ports along the underside thereof;

(e) at least a third plenum contiguous with said second plenum;

(f) the outer wall of said third plenum taller than the inner wall of said third plenum, and including a top and bottom closure attached to said outer wall and said third plenum;

(g) said second and third plena filled to a selected level with water;

(h) a plurality of horizontal spaced pipes arranged in zig-zag connection within said third plenum, for carrying liquid to be vaporized; and (i) at least one stack means connected to the space above said second and third plena for the escape of cooled products of combustion to the atmosphere.

10. The apparatus as in claim 9 including baffle plates attached to said pipes below said ports.

* * * * *